US008499394B1

(12) United States Patent
Haydu

(10) Patent No.: US 8,499,394 B1
(45) Date of Patent: Aug. 6, 2013

(54) WATERPROOF EXPANSION JOINT

(75) Inventor: Joseph Haydu, Riverside, CA (US)

(73) Assignee: Versaflex, Inc., Riverside, CA (US)

( * ) Notice: Subject to any disclaimer, the term of this patent is extended or adjusted under 35 U.S.C. 154(b) by 0 days.

(21) Appl. No.: 13/480,310

(22) Filed: May 24, 2012

Related U.S. Application Data

(60) Provisional application No. 61/552,284, filed on Oct. 27, 2011.

(51) Int. Cl.
*E01C 11/02* (2006.01)

(52) U.S. Cl.
USPC ..... 14/73.1; 404/56; 404/68; 404/69; 52/393

(58) Field of Classification Search
USPC ..... 404/47, 56, 64, 68, 69; 14/73.1, 14/73.5; 52/393, 395
See application file for complete search history.

(56) References Cited

U.S. PATENT DOCUMENTS

| | | | | |
|---|---|---|---|---|
| 1,896,641 | A * | 2/1933 | O'Brien | 404/56 |
| 2,025,449 | A * | 12/1935 | Heltzel | 404/74 |
| 3,172,237 | A | 3/1965 | Bradley | |
| 3,810,707 | A * | 5/1974 | Tungseth et al. | 404/67 |
| 3,829,228 | A | 8/1974 | Miyazaki et al. | |
| 3,880,539 | A | 4/1975 | Brown | |
| 4,111,582 | A | 9/1978 | Tippett | |
| 4,295,311 | A | 10/1981 | Dahlberg | |
| 4,359,847 | A | 11/1982 | Schukolinski | |
| 4,533,278 | A | 8/1985 | Corsover et al. | |
| 4,572,702 | A | 2/1986 | Bone | |
| 4,784,516 | A | 11/1988 | Cox | |
| 4,793,162 | A * | 12/1988 | Emmons | 404/69 |
| 4,963,056 | A | 10/1990 | Cihal | |
| 5,171,100 | A | 12/1992 | Bergstedt et al. | |
| 5,197,250 | A | 3/1993 | Kramer | |
| 5,269,624 | A | 12/1993 | Kramer | |
| 5,282,693 | A | 2/1994 | Daily, Jr. | |
| 5,365,713 | A * | 11/1994 | Nicholas et al. | 52/573.1 |
| 6,039,503 | A | 3/2000 | Cathey | |
| 6,450,729 | B1 * | 9/2002 | Clapp | 404/75 |
| 6,491,468 | B1 * | 12/2002 | Hagen | 403/291 |
| 6,619,879 | B1 | 9/2003 | Scuero | |
| 6,751,919 | B2 * | 6/2004 | Calixto | 52/573.1 |
| 7,354,219 | B2 | 4/2008 | Leonberg | |
| 7,744,307 | B2 | 6/2010 | Moor et al. | |
| 2008/0247822 | A1 | 10/2008 | Moor et al. | |

FOREIGN PATENT DOCUMENTS

| | | |
|---|---|---|
| KR | 20060111215 | 10/2006 |
| RU | 2237124 | 9/2004 |

OTHER PUBLICATIONS

Watson Bowman ACME Corp., Bridge & Highway Maintenance Expansion Joint Systems, http://www.wbacorp.com/downloads/Bridge%20Maintenance%20brochure-webopt.pdf, 2008, 20 pages.

* cited by examiner

*Primary Examiner* — Gary Hartmann
(74) *Attorney, Agent, or Firm* — Knobbe, Martens, Olson & Bear, LLP

(57) ABSTRACT

A waterproof expansion joint comprises a ballast protection plate with one or more centering tabs. Waterproof receptacles, or T-cups, are used to provide a waterproof layer under the ballast protection plate and around the centering tabs. Sealing tape and a spray-based waterproof membrane are installed with the T-cups. Once the ballast protection plate is placed over the deck joint with centering tabs extending downward into the T-cups, a bond breaker is applied. Finally, a second layer of waterproof membrane is applied to the top of all elements of the waterproof expansion joint.

23 Claims, 7 Drawing Sheets

WATERPROOF EXPANSION JOINT

CROSS-REFERENCE TO RELATED APPLICATIONS

This application claims the benefit of U.S. Provisional Application No. 61/552,284 filed Oct. 27, 2011 which is hereby incorporated by reference in its entirety.

BACKGROUND OF THE INVENTION

1. Field of the Invention

This application relates to waterproof expansion joints for railway bridges.

2. Background of the Related Art

Railway bridges are continually in a state of motion. Expansion and contraction caused by changes in thermal conditions, deflections caused by live loads, and longitudinal forces caused by railway traffic all combine to produce nearly continuous motion in the decks of railway bridges. The most common method of accommodating this movement, and the forces associated with it, is the deck joint. Deck joints—spaces between the girders that make up the deck of the bridge—allow the bridge to experience expansion, contraction, deflection, etc. without damage. Railway bridges are typically covered with ballast, however, requiring some method of sealing the deck joints to be incorporated into the bridge design in order to inhibit the ballast from falling through the deck joints and creating a potentially hazardous situation below the bridge. One method of inhibiting this leakage of ballast is by covering the deck joints with rigid ballast protection plates.

While accommodating the expansion, contraction, displacement, and other movements of bridge decks, deck joints may allow water to pass through, creating potentially hazardous situations under the bridge, including icicles. Ballast protection plates do not typically inhibit the leakage of water through the deck joint. Existing methods of waterproofing deck joints are designed with automobile bridges in mind. Such waterproof joints do not withstand the pressure of ballast and railways.

Therefore, there is a need for waterproof expansion joints that stand up to the stresses of railway bridges and the ballast associated with them while still providing adequate protection from water leakage. Such a waterproof expansion joint will provide the benefits of waterproofing the deck joints without substantially altering the manner in which railway bridges are constructed, for example with ballast protection plates having centering tabs coupled to their bottom face.

SUMMARY OF THE INVENTION

The systems, methods, and devices of the invention each have several aspects, no single one of which is solely responsible for its desirable attributes. Without limiting the scope of the invention, certain features will now be discussed briefly.

In one embodiment, a waterproof expansion joint comprises a ballast protection plate with one or more centering tabs. Waterproof receptacles, or T-cups, are used to provide a waterproof layer under the ballast protection plate and around the centering tabs. Sealing tape and a spray-based waterproof membrane are installed with the T-cups. Once the ballast protection plate is placed over the deck joint with centering tabs extending downward into the T-cups, a bond breaker is applied. Finally, a second layer of waterproof membrane is applied to the top of all elements of the waterproof expansion joint.

The T-cups can be made of any suitable material able to withstand the lateral movement of the centering tab contained within. The waterproof membrane can be made of any suitable material able to withstand the extremes of outdoor use, the motion and forces attended in expansion bridges, and the course ballast piled above.

BRIEF DESCRIPTION OF THE DRAWINGS

Certain embodiments of the disclosure will now be discussed in detail with reference to the following figures. These figures are provided for illustrative purposes only, and the disclosure is not limited to the subject matter illustrated in the figures.

DETAILED DESCRIPTION OF THE PREFERRED EMBODIMENT

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
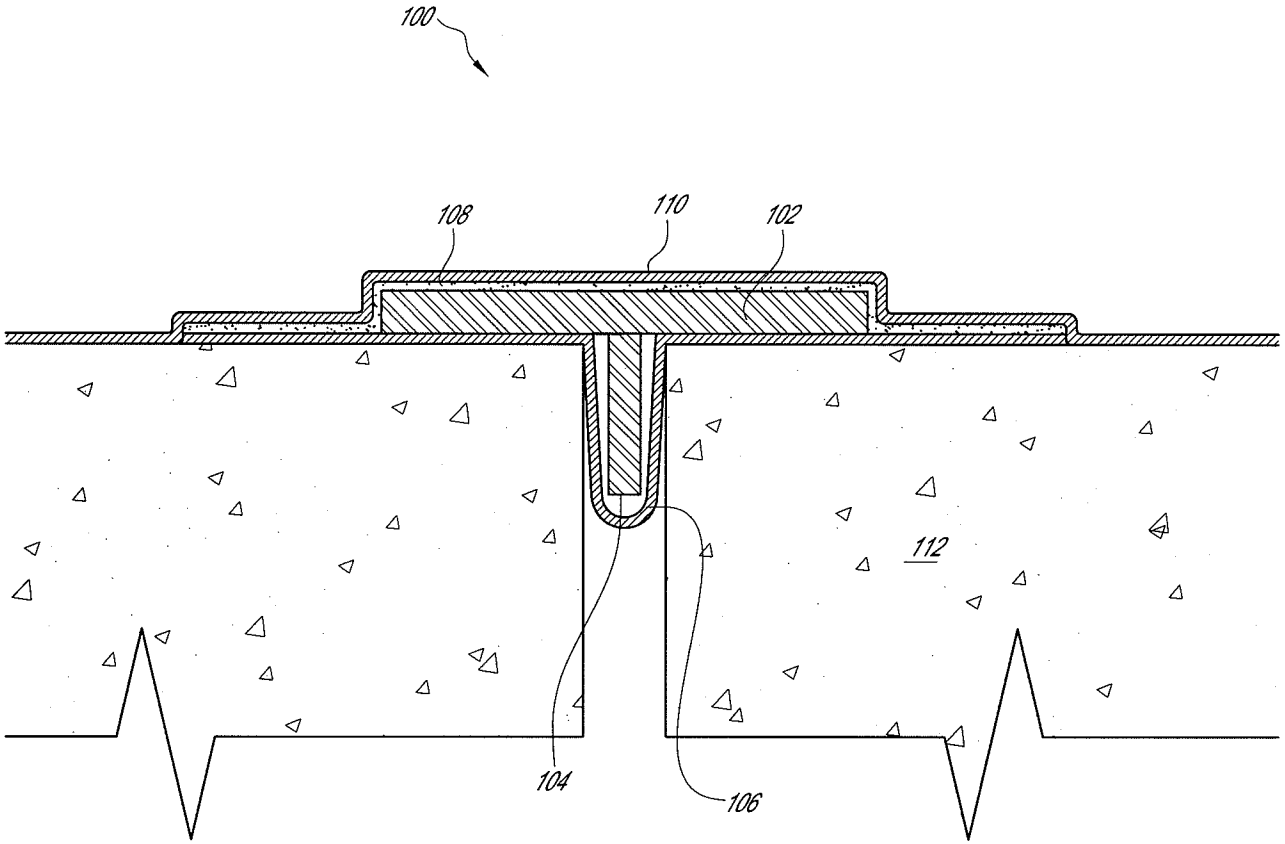
FIG. 1 is a cross-sectional view of one embodiment of a waterproof expansion joint for railway bridges.

FIG. 1 illustrates a cross sectional view of one embodiment of a waterproof expansion joint 100. The deck of a railway bridge can be composed of a plurality of box beam girders 112, which are then covered with ballast, for example crushed rock or gravel. Railroad tracks are installed on the ballast. The box beam girders 112 can be hollow girders formed from concrete or reinforced concrete, but may also be made of any other material of sufficient strength and durability to withstand the stress placed on a railway bridge. The girders 112 are placed side-by-side and/or end-to-end, depending on the specific requirements of the span. Adjacent box beam girders 112 can define deck joints 114. Deck joints 114 are spaces which allow expansion and contraction of girders 112 without causing damage to adjacent girders 112 or other components of the bridge. Generally, the deck joints 114 are covered by ballast protection plates 102 to inhibit the ballast from falling through the deck joints 114 and potentially creating a hazardous situation below the bridge. However, neither the ballast nor the ballast protection plates 102 are adequate to inhibit water from leaking through the deck joints 114. The waterproof expansion joint 100 of FIG. 1 adds several components to the traditional box girder bridge to inhibit water leakage through the deck joints 114.

The waterproof expansion joint 100 comprises a ballast protection plate 102 that is positioned over the deck joint 114. The ballast protection plate 102 can be configured to move laterally with respect to the deck joint 114 during the expansion and contraction of the girders 112 and the bridge as a whole. The ballast protection plate 102 has one or more centering tabs 104 to limit the amount of lateral movement of the ballast protection plate 102 with respect to the deck joint 114. Also, a waterproof receptacle, such as a T-cup 106, may be provided to facilitate the installation of a waterproof layer between the ballast protection plate 102 and the girders 112. The waterproof expansion joint 100 additionally includes a bond breaker 108 and one or more waterproof membranes 110. The T-cups 106 fit into the deck joint 114 between the girders 112, and are positioned to accept the centering tabs 104 of the ballast protection plate 102 when it is placed on the deck joint 114. The T-cups 106 can be covered with a layer of waterproof membrane 110 prior to installation of the ballast protection plate 102. The ballast protection plate 102 can be placed over the deck joint 114, with its centering tabs 104 inserted into the T-cups 106. A bond breaker 108 can be applied to the ballast protection plate 102, and a second layer of waterproof membrane 110 can be applied over the entire waterproof expansion joint 100.

The number of ballast protection plates 102 can depend on the specific features of the bridge. For example, a bridge comprising a large number of girders 112 can have a proportionately large number of deck joints 114, with each deck joint 114 requiring a ballast protection plate 102. The ballast protection plate 102 is generally elongate. In some embodiments, a ballast protection plate 102 can be created with alternative designs, such as L- and Z-shaped ballast protection plates 102, to cover a plurality of deck joints 114. The length of some deck joints 114 may require more than one ballast protection plate 102. In some embodiments, the ballast protection plate 102 is rectangular in shape. In some embodiments, the ballast protection plate 102 may have rounded edges and be generally oval in shape. The ballast protection plate 102 can be made of material sufficiently rigid to support the ballast under which will be placed, for example galvanized steel. The material of the ballast protection plate 102 can also be selected to resist any corrosive effects caused by the liquid leaking through the ballast that it is exposed to.

One or more centering tabs 104 can be rigidly attached to the underside of the ballast protection plate 102, for example by welding. Alternatively, the centering tabs 104 can riveted, bolted, or otherwise semi-permanently or permanently coupled to the ballast protection plate 102. The centering tabs 104 can be made of the same material as the ballast protection plate 102, and can be generally rectangular. In some embodiments, the centering tabs 104 can take an alternative shape that retains the ballast protection plate 102 in alignment with the joint, such as circular, triangular, etc. The centering tabs 104 can extend two (2) inches below the ballast protection plate 102. In some embodiments, the centering tabs 104 can extend more than two (2) inches below the ballast protection plate 102, depending on the width of the deck joint 114 and the range of expected change in elevation that the girders 114 will experience. For example, if the girders 114 of the bridge are expected to experience elevation changes in the range of 1.5 inches, a centering tab 104 extending more than 2 inches into the deck joint 114 may be desirable.

The centering tabs 104 inhibit the ballast protection plate 102 from shifting laterally, with respect to the deck joint 114, a distance great enough that the ballast protection plate 102 no longer covers the deck joint 114. In the absence of centering tabs 104, repetitive expansion and contraction of the girders 112 could potentially shift the position of the ballast protection plate 102 laterally and uncover the deck joint 114, allowing ballast to fall through the deck joint 114 and defeating the purpose of having a ballast protection plate 102. In such cases the ballast protection plate 102 itself could also fall through the deck joint 114, adding to the danger. To inhibit such excessive shifting of the ballast protection plate 102, one or more centering tabs 104 can be attached to the bottom face of the ballast protection plate 102, centered laterally between the edges of the ballast protection plate 102, with the longitudinal axis of the centering tabs 104 aligned parallel to the longitudinal axis of the ballast protection plate 102 and deck joint 114. The width of the ballast protection plate 102 is generally more than twice as wide as the widest anticipated width of the deck joint 114 between the girders 112. In this configuration, the position of the ballast protection plate 102 can shift only as far as the centering tab 104 will allow before the centering tab 104 contacts one of the girders 112. Because the centering tabs 104 are aligned with the longitudinal axis of the ballast protection plate 102, the ballast protection plate 102 will still completely cover the deck joint 114 and overlap onto both girders 112 even when the centering tab 104 is in contact with either of the girders 112.

In some embodiments, the width of a deck joint 114 may be exceptionally wide, and a ballast protection plate 102 with a single centering tab 104, centered laterally between the edges of the ballast protection plate 102, may allow an unacceptably large shift in the position of the ballast protection plate 102 with respect to the deck joint 114. In such cases, two or more centering tabs 104 may be mounted to the same segment of the ballast protection plate 102, positioned with their longitudinal axes parallel to each other and parallel to the longitudinal axis of the ballast protect plate 102. The dual centering tabs 104 provide the benefits described above, namely contacting the girders 114 and inhibiting excessive shift of the ballast protection plate 102. In the dual centering tab 104 configuration, each centering tab 104 is responsible for contacting only one of the girders 112 that define the deck joint 114.

One problem, among others, that is presented by centering tabs 104 mounted to the bottom face of the ballast protection plate 102 is that the protruding centering tabs 104 can prevent a waterproof sealant from being used below the ballast protection plate 102. Waterproof cup members, such as T-cups 106, can facilitate placement of a waterproof layer under the ballast protection plate 102. T-cups 106 can be placed in the deck joint 114 at the locations where the centering tabs 104 will enter the deck joints 114 when the ballast protection plate 102 is installed.

Figure 2:
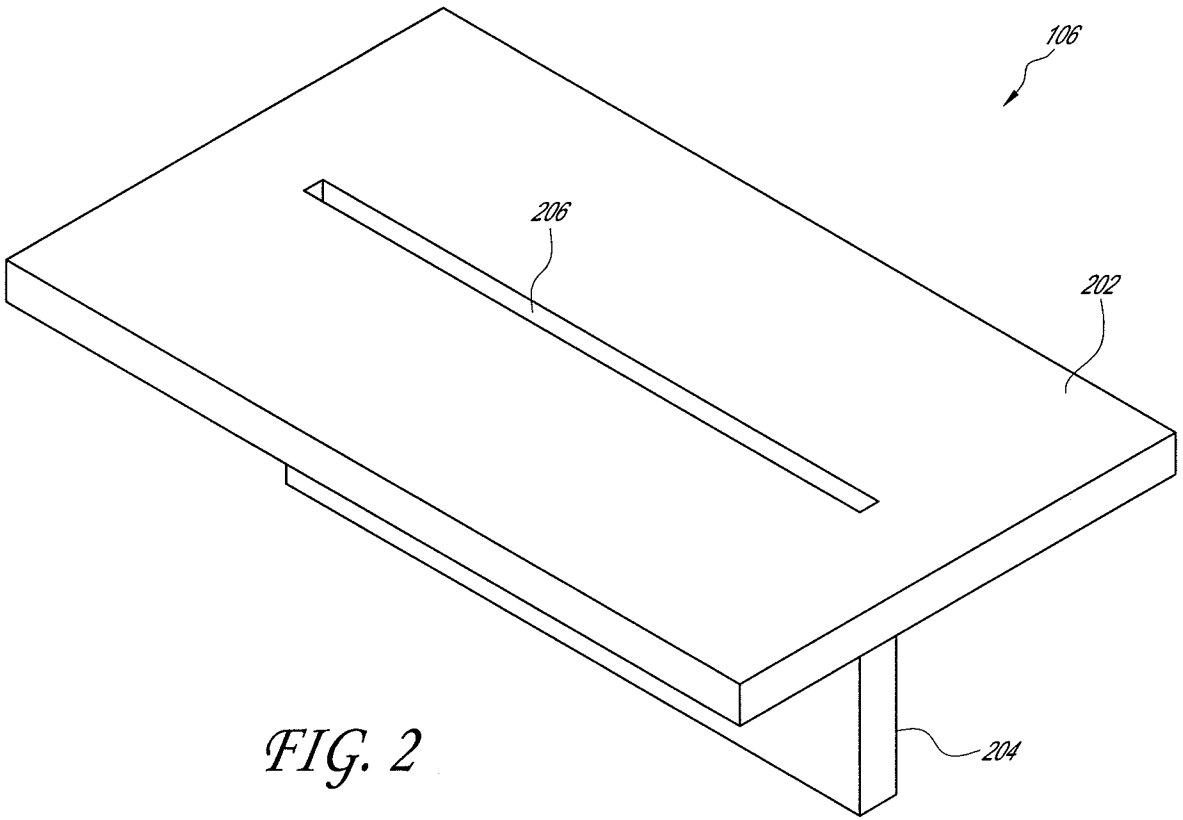
FIG. 2 is a perspective view of one embodiment of a T-cup waterproofing member.

FIG. 2 illustrates a perspective view of one embodiment of a T-cup 106 waterproof member. The T-cup 106 comprises a flange 202 and a cup 204. The flange 202 forms the upper end of the T-cup 106, and the cup 204 extends downward from the bottom face of the flange 202. The flange 202 defines the opening 206 of the cup 204, and extends completely around the opening 206 and the top edge of the cup 204. The flange 202 can be sized so that the entire top face of the T-cup 106 is substantially the same width as the ballast protection plate 102. The flange 106 can be configured so that the top face of the T-cup 106 is substantially rectangular or square. In some embodiments, the flange 106 can be configured to provide a round shape to the top face of the T-cup 106, which may reduce the material required to manufacture the T-cups 106 and thereby reduce manufacturing costs. The opening 206 can be substantially the same size as the interior of the cup 204. The cup 204 can be sized to fit the centering tabs 104 that will be inserted. Typically, the interior dimensions of the cup 204 will be slightly larger than the dimensions of the centering tabs 104, to facilitate installation while maintaining a snug fit. In some embodiments, the T-cup can have two or more openings 206 and cups 204, for example in applications requiring ballast protection plates 102 with dual centering tabs 104, as described above. In such applications, the T-cup can have two cups 204 aligned parallel to each other, with two openings 206 in the flange 202.

Prior to installation of the waterproof expansion joint 100, the surface of the bridge deck is preferably level. Due to the ballast that is placed on the girders 112 prior to installation of railroad tracks, the manufacturing and/or installation tolerance may not be precise because railroad tracks are not mounted directly to girders 112, but rather they are installed onto the ballast. Therefore, one or more girders 112 may not be level with the others. For example, the top surface of one girder 112 may be at a different elevation than a girder 112 on the other side of a deck joint 114. One problem that this presents, among others, is that the ballast protection plates 102 may not sit flat against the girders 112 on both sides of the deck joint 114. In such cases, grout, cement, or another type of patch can be applied to the girder 112 at the lower elevation to bring the surfaces of the two girders 112 level.

Assembly of the waterproof expansion joint 100 begins with placement of the T-cups 106. The T-cups 106 are preferably positioned where the tabs 104 of the ballast protection plate 102 will enter the deck joint 114 between the girders 112. This pre-placement allows a waterproof layer, such as waterproof membrane 110, to be applied prior to final placement of the ballast protection plates 102, as described in detail below. Pre-placement can involve temporarily installing the T-cups 106 on the ballast protection plate 102. The T-cups 106 are placed on the centering tabs 104, and then the ballast protection plate 102 is then placed over the deck joint 114 between the girders 112, with the centering tabs 104 and T-cups 106 extending downward into the deck joint 114. The position of the T-cups 106 can be marked on the girders 112 for future reference. The ballast protection plate 102 is then removed, and the T-cups 106 can either remain in place or be removed with the ballast protection plate 102 and replaced in the deck joint 114 between the girders 112 at the marked positions. In some embodiments, the ballast protection plate 102 is not temporarily installed. Instead, the space between each centering tab 104 is measured, and markings are made on the girders 112 based upon these measurements to indicate where the T-cups 106 are to be installed.

Figure 3:
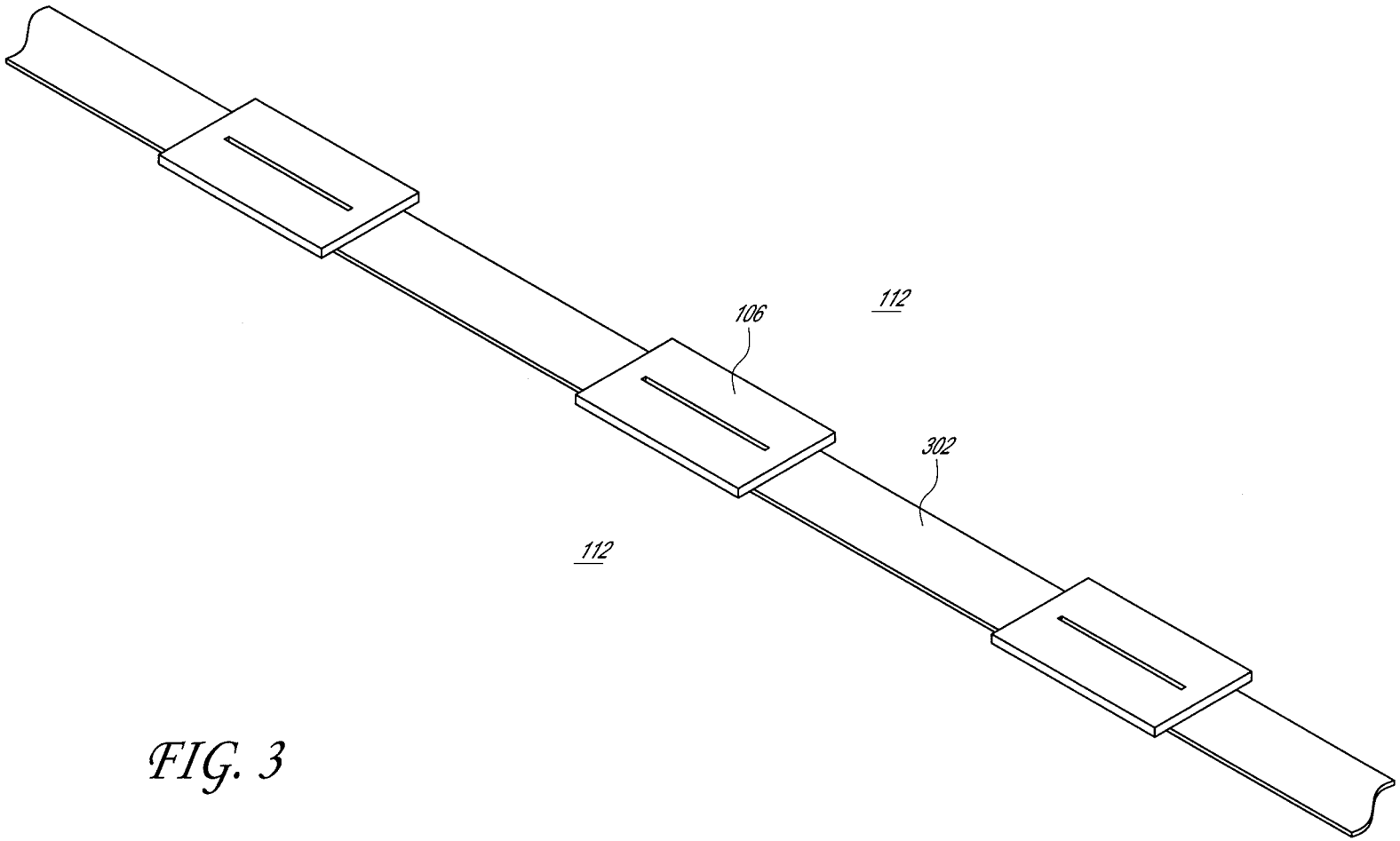
FIG. 3 is a perspective view of one embodiment of a waterproof expansion joint in the process of being installed, illustrating T-cup waterproofing members and sealing tape.

FIG. 3 illustrates a perspective view of one embodiment of a deck joint 114 with T-cups 106 positioned to accept the centering tabs 104 of a ballast protection plate 102. After the proper position of the T-cups 106 is marked, as described above, the T-cups 106 are placed into the deck joint 114, with the flange 202 of each T-cup 106 contacting the upper surface of the girders 112 on each side of the deck joint 114. The flange 202 prevents the T-cup 106 from falling through the deck joint 114.

The portions of the deck joints 114 that are not covered by the T-cups 106 are sealed with sealing tape 302. Sealing tape 302 is installed between the T-cups 106, and covers the deck joint 114 while overlapping onto the edge of each of the girders 112. The sealing tape 302 can be fiber-reinforced butyl tape. The sealing tape 302 can be installed while the T-cups 106 are in position, by partially lifting the flange 202 of each T-cup 106 to place the sealing tape 302 underneath. Alternatively, the T-cups 106 can be removed after marking their proper position, as described above with respect to FIG. 3, and the sealing tape 302 can be installed prior to replacing the T-cups 106 at the positions marked. The sealing tape 302, when coupled with the T-cups 106, provides a waterproof layer covering the entire deck joint 114.

Figure 4:
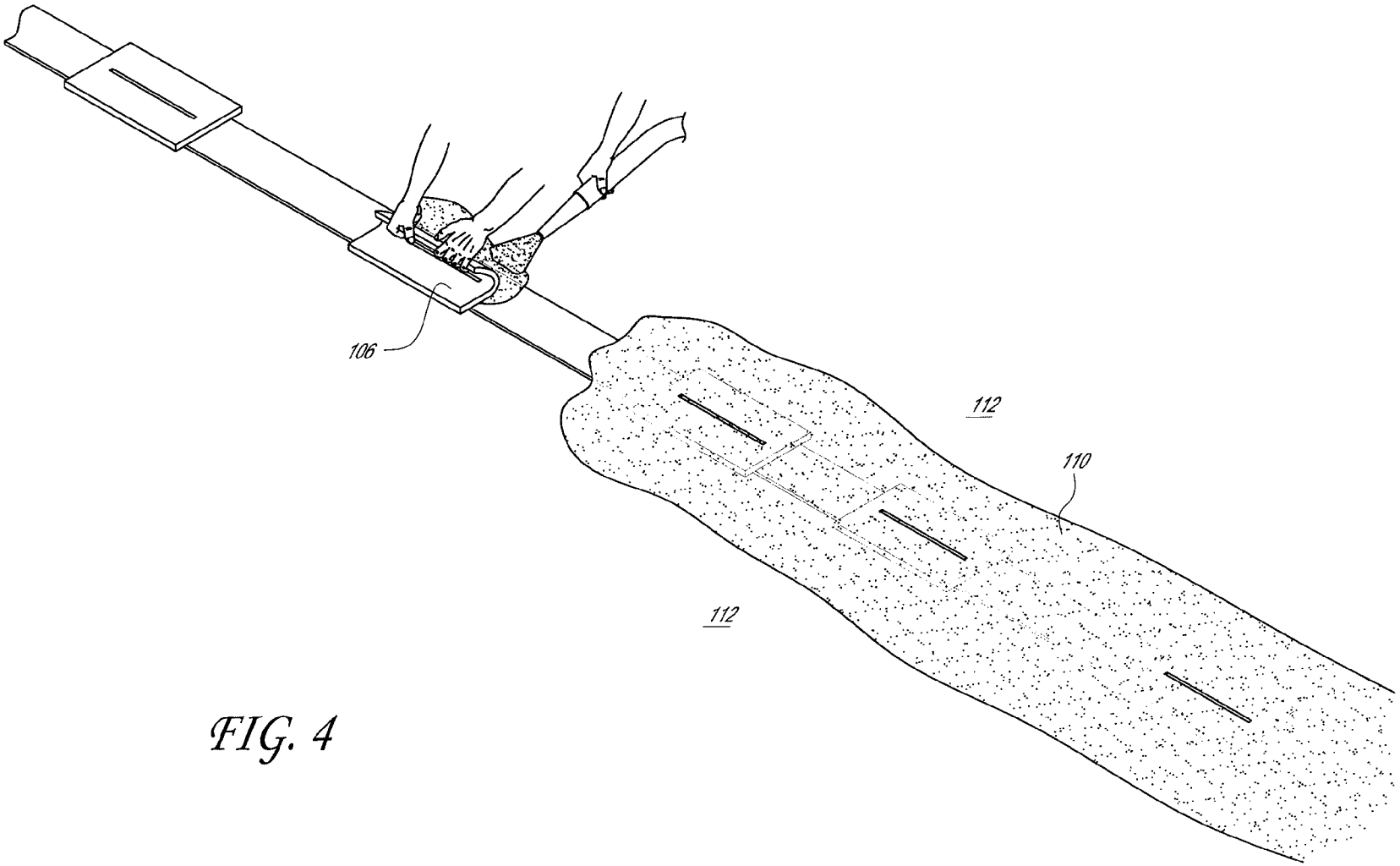
FIG. 4 is a perspective view of one embodiment of a waterproof expansion joint in the process of being installed, illustrating waterproof membrane being applied.

FIG. 4 illustrates one embodiment of the waterproof expansion joint 100 of FIG. 3 at a later stage of installation. After the sealing tape 302 has been installed and the T-cups 106 are in position, a waterproof membrane 110 is installed. The waterproof membrane 110 can be a polyurea, such as AquaVers 405™. As described in more detail below, each layer of the waterproof membrane can be 100 mils.

An adhesive layer is installed between the flange 202 of each T-cup 106 and a girder 112. The adhesive layer can be a primer application and can be applied prior to the placement of the waterproof membrane 110. The adhesive layer can be the same material as all or part of the waterproof membrane 110, such as a polyurea. The adhesive layer can be applied by spraying the material while it is in a substantially fluid state. The flange 202 can then be lowered back into place, with the adhesive layer acting to hold the T-cup 106 in its proper position and effectively sealing the area where the flange 202 of each T-cup 102 meets the surface of each girder 112. In some embodiments, there is no adhesive layer applied between the flange 202 of the T-cups 106 and the girder 112.

As illustrated in FIG. 4, the waterproof membrane 110 can be applied by spraying the material while it is in a substantially fluid state. After each T-cup 106 has been sealed to the girders 114 with an adhesive layer, waterproof membrane 110 can be applied to the top of each T-cup 106 and each section of sealing tape 302. The end result of this application of the waterproof membrane 110 can be one layer of waterproof membrane 110 along the entire length of the deck joint 114. The width of the layer of waterproof membrane 110 is typically greater than the width of the ballast protection plates 102 that will be installed onto the deck joint 114. In this configuration, the waterproof membrane 110, the T-cups 106, and sealing tape 302 form a waterproof base layer upon which to install the ballast protection plate 102.

Figure 5:
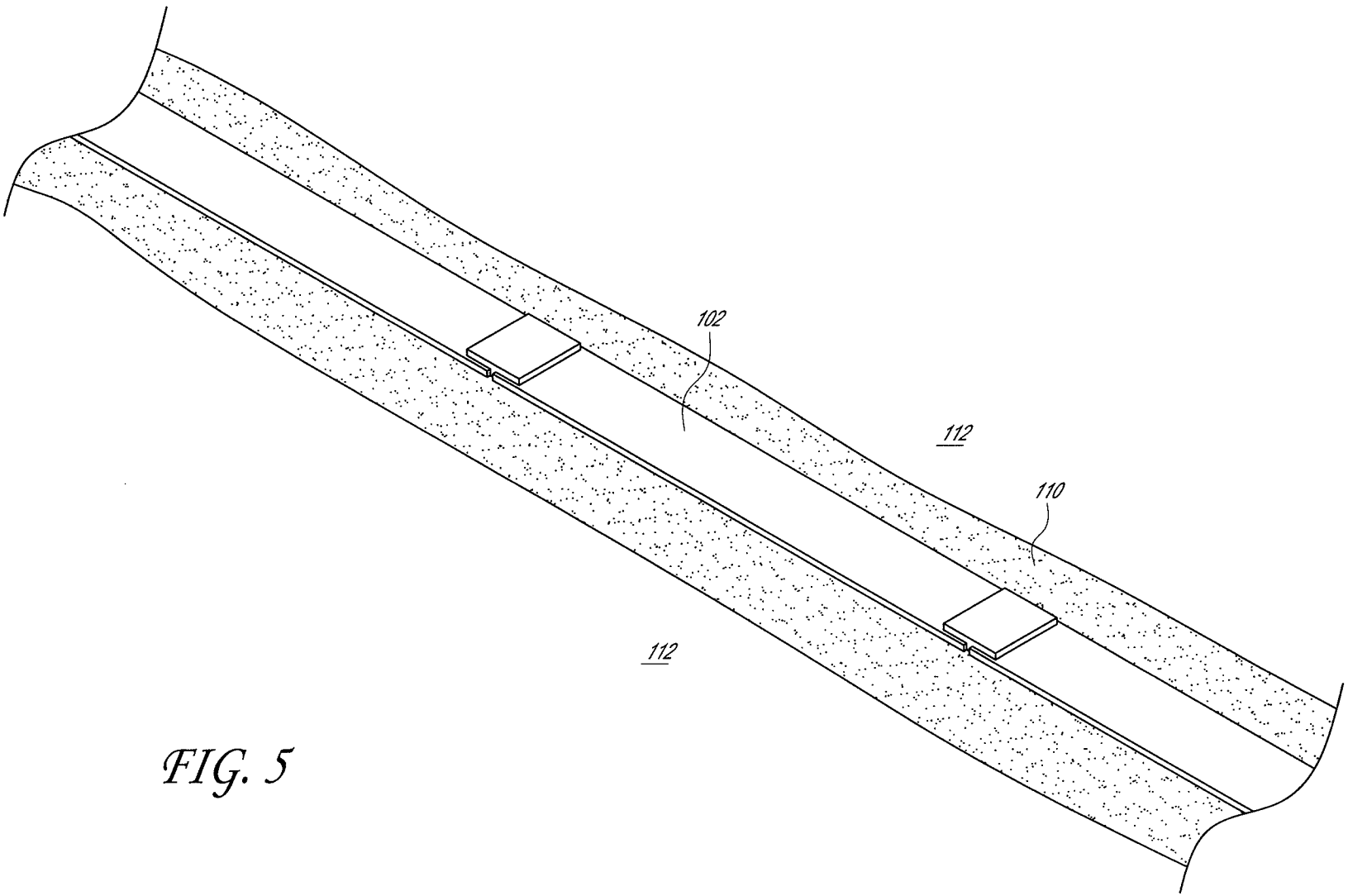
FIG. 5 is a perspective view of one embodiment of a waterproof expansion joint in the process of being installed, illustrating ballast protection plates.

The assembly process illustrated in FIG. 5 is a continuation of the process illustrated in FIG. 4. After the base layer of waterproof membrane 110 has been applied over the sealing tape 302 and T-cups 106, the ballast protection plate 102 can be installed. Generally, the ballast protection plate 102 is placed over the deck joint 114, with the centering tabs 104 extending through the opening 204 and into the cup 206 of each T-cup 106. The waterproof membrane 110 can be seen in FIG. 5 under and adjacent the ballast protection plate 102 on the box beam girders 112. In some embodiments, more than one ballast protection plate 102 can be installed, for example when the deck joint 114 is longer than a single ballast protection plate 102.

Figure 6:
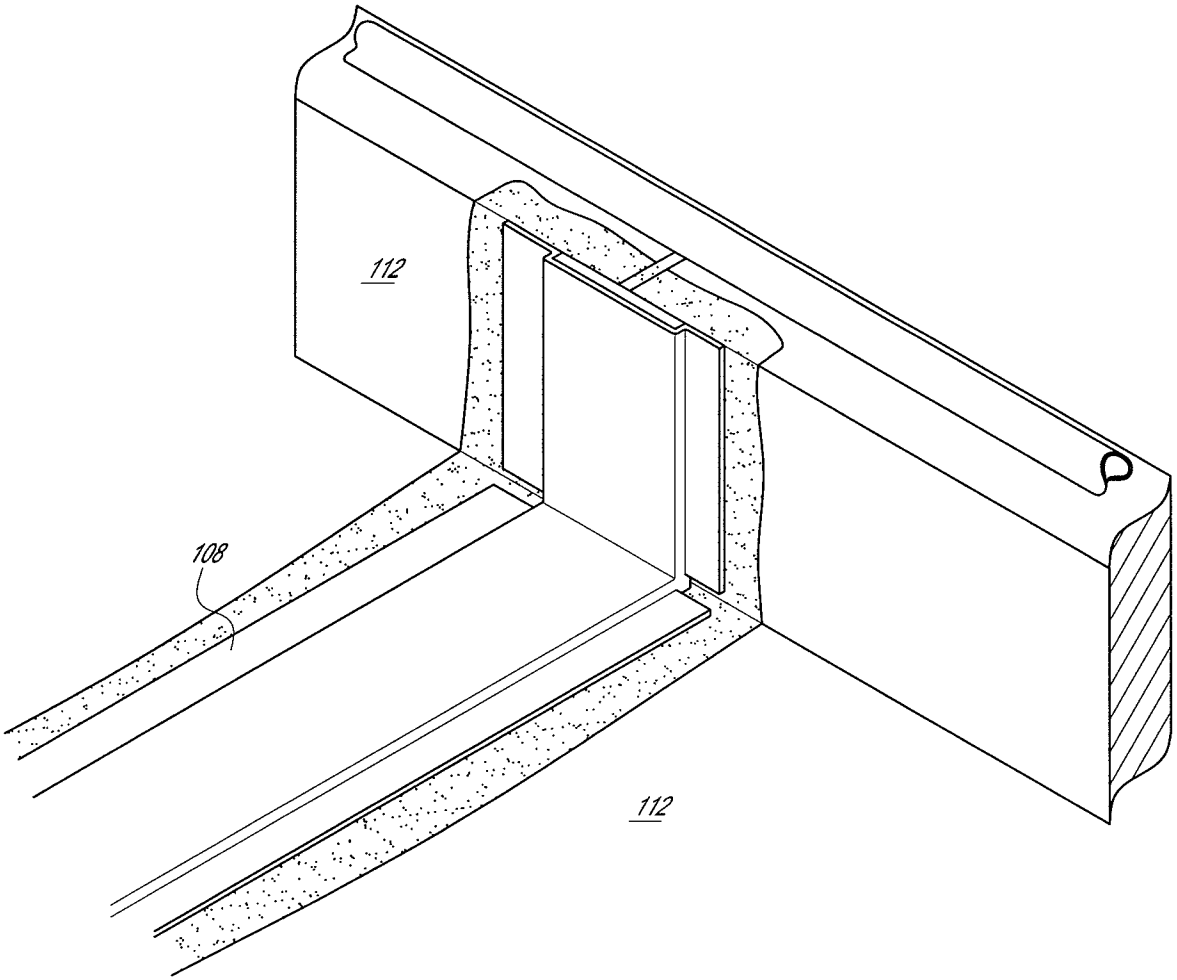
FIG. 6 is a perspective view of one embodiment of a waterproof expansion joint in the process of being installed, illustrating bond breaker.

FIG. 6 illustrates a perspective view of one embodiment of the waterproof expansion joint 100 of FIG. 5 at a later stage of installation. The edge of the expansion joint 100 illustrated in FIG. 5 is at the side of the bridge, a location where the bridge can have raised edges. Like the flat deck of the bridge, the raised edges can also have deck joints to allow for expansion and contraction. Therefore, the various components of the waterproof expansion joint 100 can also be used to waterproof the deck joint in the bridge's raised edge, including a ballast protection plate 102, bond breaker 108, waterproof membrane 110, etc.

When the ballast protection plates 102 have been installed, a bond breaker 108 can be applied. The bond breaker 108 covers the ballast protection plate 102 and overlaps the waterproof membrane 110 that has been sprayed onto the girders 112. The bond breaker 108 can be roofing tape, melroe tape, etc. The bond breaker 108 provides a unified surface upon which to apply a second layer of waterproof membrane 110, as described below, and also facilitates the movement of the ballast protection plate 102. When the girders 112 expand and contract the deck joint 114 in which the components of the waterproof expansion joint 100 are installed, the ballast protection plate 102 can shift position laterally, perpendicular to the deck joint 114 and to the longitudinal axis of the ballast protection plate 102. The bond breaker 108 allows such movement by the ballast protection plate 102 without compromising the seal of the waterproof membrane 110 installed on top of the bond breaker 108, as described in detail below, by inhibiting formation of a permanent bond between the ballast protection plate 102, and the second layer of waterproof membrane 110 installed on top of the bond breaker 108.

Figure 7:
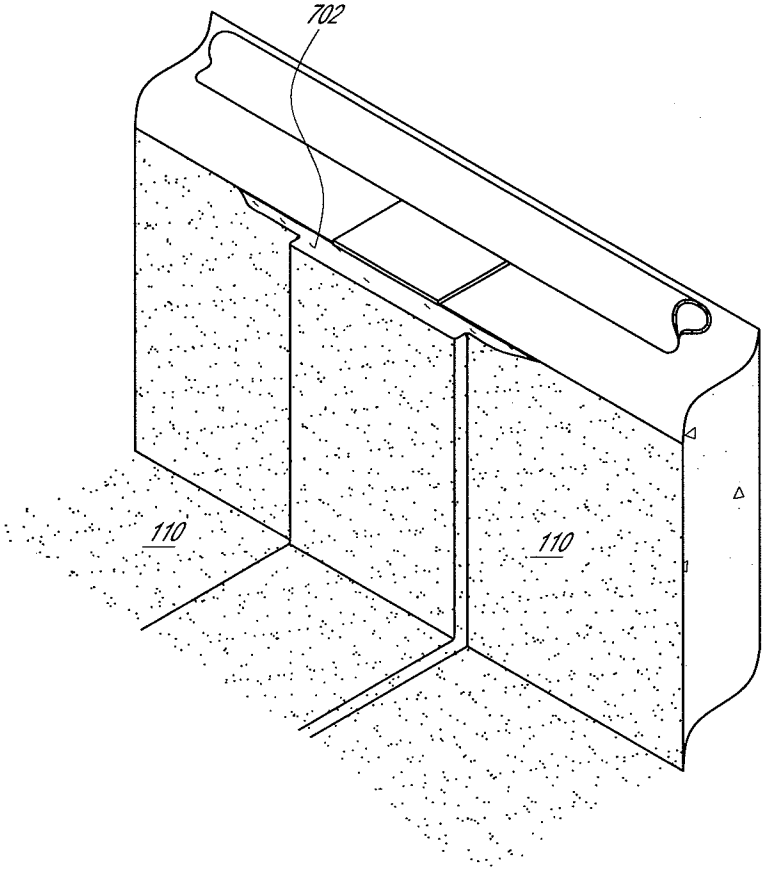
FIG. 7 is a perspective view of one embodiment of a waterproof expansion joint fully installed.

FIG. 7 illustrates a perspective view of one embodiment of a waterproof expansion joint 100 fully assembled and installed. The view illustrated in FIG. 7 includes a raised edge of the bridge, described above with respect to FIG. 6. The components installed as described in detail above are shown in FIG. 7 completely covered with a second layer of waterproof membrane 110. As in FIG. 4, described above, the second layer waterproof membrane 110 can be applied by spraying the material while it is in a substantially fluid state. The second layer of waterproof membrane 110 is between 10 and 150 millimeters thick, and may be 80 to 120 millimeters thick. In some embodiments, the second layer of waterproof membrane 110 can be 100 mils thick.

The second layer of waterproof membrane 110 can cover all or part of the bond breaker-covered ballast protection plates 102 and/or may also cover all or part of one or more surfaces of the girders 112. In some embodiments, the second layer of waterproof membrane 110 can cover substantially the entire dorsal surface of the bridge deck. The second layer of waterproof membrane 110 defines a substantially horizontal fluid tight seal on the surface of the bridge deck. In embodiments in which the second layer of waterproof membrane 110 covers the entire dorsal surface of the bridge deck, there will be no seams in the second layer of waterproof membrane 110, which may reduce weak points in the fluid tight seal.

The location where deck joint 114 reaches the end of a pair of girders 112 can present an area of weakness in the overall waterproof expansion joint 100. As shown in FIG. 7, where the edges of the deck joint 114, girders 112, ballast protection plate 102, and other components of the waterproof expansion joint 100 align, caulking 702 may be applied to provide a fluid tight seal. The fluid tight seal formed by the second layer of waterproof membrane, coupled with the caulking 702, T-cups 106, sealing tape 302, and first layer of waterproof membrane 110, advantageously increases the distance a fluid must penetrate before breaching the seal, and prevents a failure in the seal at one isolated position from allowing fluids to penetrate the seal.

The foregoing description details certain embodiments. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A waterproof expansion joint comprising:

a plurality of waterproof receptacles extending into a deck joint, the deck joint defined by at least two girders, the plurality of waterproof receptacles each having an upper flange not extending into the deck joint;

a plate with a plurality of centering tabs, the centering tabs extending into the plurality of waterproof receptacles, wherein the plate inhibits ballast from falling into the deck joint; and a waterproof membrane over the deck joint and at least partially overlapping the at least two girders, wherein the waterproof membrane inhibits the flow of water to the deck joint.

2. The waterproof expansion joint of claim 1, wherein the waterproof membrane is over the plate.

3. The waterproof expansion joint of claim 1, wherein the waterproof membrane is below the plate.

4. The waterproof expansion joint of claim 3, further comprising a second waterproof membrane over the plate, wherein the second waterproof membrane inhibits the flow of water to the plate.

5. The waterproof expansion joint of claim 4, further comprising a bond breaker, wherein the bond breaker inhibits the second waterproof membrane from bonding to the plate.

6. The waterproof expansion joint of claim 1, further comprising a caulk sealant positioned where the end of the plate aligns with the edge of the deck joint, wherein the caulk sealant inhibits the flow of water to the deck joint.

7. The waterproof expansion joint of claim 1, wherein the waterproof membrane comprises a polyurea.

8. The waterproof expansion joint of claim 1, wherein the waterproof membrane is between approximately 80 mm and 120 mm thick.

9. The waterproof expansion joint of claim 1, wherein the plate comprises galvanized steel.

10. The waterproof expansion joint of claim 1, comprising a plurality of plates.

11. The waterproof expansion joint of claim 1, wherein the centering tabs define a longitudinal axis, and wherein the longitudinal axis of the centering tabs is parallel to the deck joint.

12. The waterproof expansion joint of claim 1, further comprising a sealing strip over between the waterproof receptacles and over the deck joint, wherein the sealing strip inhibits water from flowing to the deck joint.

13. The waterproof expansion joint of claim 12, wherein the sealing strip is fiber-reinforced butyl tape.

14. A method of waterproofing a deck joint of a bridge, the method comprising:

placing waterproof receptacles at predetermined distances in the deck joint of a bridge, wherein the predetermined distances correspond to the distances between a plurality of centering tabs on a plate, and wherein the waterproof receptacles partially extend into the deck joint;

applying a first waterproof membrane to the waterproof receptacles and over the deck joint, wherein the waterproof membrane inhibits the flow of water to the deck joint; and placing the plate over the deck joint, wherein the centering tabs extend into the cup structures, and wherein the plate inhibits ballast from falling to the deck joint.

15. The method of claim 14, further comprising applying a caulk sealant to a location where an edge of the plate meets the deck joint, wherein the caulk sealant inhibits the flow of water to the deck joint.

16. The method of claim 14, further comprising placing a sealing strip over the expansion joint wherein the waterproof receptacles at least partially overlap the sealing strip.

17. The method of claim 16, wherein the sealing strip is fiber-reinforced butyl tape.

18. The method of claim 14, wherein the first waterproof membrane comprises a polyurea.

19. The method of claim 14, wherein the applying the first waterproof membrane comprises spraying the waterproof membrane on the waterproof receptacles while the first waterproof membrane is in a substantially fluid state.

20. The method of claim 14, further comprising applying a second waterproof membrane over the plate, wherein the second waterproof membrane inhibits water from flowing to the deck joint.

21. The method of claim 20, further comprising placing a bond breaker on the plate, wherein the bond breaker inhibits the second waterproof membrane from adhering to the pate.

22. The method of claim 21, wherein the applying the second waterproof membrane comprises spraying the second waterproof membrane on the bond breaker while the second waterproof membrane is in a substantially fluid state.

23. The method of claim 20, wherein the second waterproof membrane covers substantially the entire bridge.

* * * * *

UNITED STATES PATENT AND TRADEMARK OFFICE

CERTIFICATE OF CORRECTION

PATENT NO. : 8,499,394 B1
APPLICATION NO. : 13/480310
DATED : August 6, 2013
INVENTOR(S) : Haydu It is certified that error appears in the above-identified patent and that said Letters Patent is hereby corrected as shown below:

In the Claims

In column 9 at line 18, In Claim 21, change "pate." to --plate.--.

Signed and Sealed this
First Day of April, 2014

Michelle K. Lee

Michelle K. Lee
*Deputy Director of the United States Patent and Trademark Office*